US011242755B2

(12) United States Patent
Takeda et al.

(10) Patent No.: US 11,242,755 B2
(45) Date of Patent: Feb. 8, 2022

(54) AXIAL FLOW TURBOMACHINE AND BLADE THEREOF

(71) Applicant: Mitsubishi Power, Ltd., Yokohama (JP)

(72) Inventors: Hiroki Takeda, Tokyo (JP); Chihiro Myoren, Tokyo (JP); Tadashi Murakata, Yokohama (JP)

(73) Assignee: Mitsubishi Power, Ltd., Yokohama (JP)

( * ) Notice: Subject to any disclaimer, the term of this patent is extended or adjusted under 35 U.S.C. 154(b) by 0 days.

(21) Appl. No.: 16/696,301

(22) Filed: Nov. 26, 2019

(65) Prior Publication Data

US 2020/0182061 A1 Jun. 11, 2020

(30) Foreign Application Priority Data

Dec. 7, 2018 (JP) ..... JP2018-230297

(51) Int. Cl.
*F01D 5/14* (2006.01)
*F01D 9/02* (2006.01)

(52) U.S. Cl.
CPC ..... *F01D 5/14* (2013.01); *F01D 5/143* (2013.01); *F01D 9/02* (2013.01); *F05D 2240/80* (2013.01)

(58) Field of Classification Search
CPC . F01D 5/30; F01D 5/143; F01D 5/145; F01D 9/042; F05D 2240/80; F05D 2250/712; F05D 2260/941
See application file for complete search history.

(56) References Cited

U.S. PATENT DOCUMENTS

2006/0153681 A1* 7/2006 Lee ..... F01D 5/145 416/97 R
2010/0166562 A1 7/2010 Boyer
2013/0052030 A1* 2/2013 McCaffrey ..... C04B 35/80 416/241 B

FOREIGN PATENT DOCUMENTS

EP 2184442 A1 * 5/2010 ..... F01D 5/143
JP 2010-156338 A 7/2010

* cited by examiner

*Primary Examiner* — Courtney D Heinle
*Assistant Examiner* — Danielle M. Christensen
(74) *Attorney, Agent, or Firm* — Crowell & Moring LLP

(57) ABSTRACT

Provided is a blade for an axial flow turbomachine, including: a blade profile section; an endwall having a flow path wall surface disposed at least on a hub side of the blade profile section and adapted to demarcate a part of an annular flow path of a working fluid; and a fillet disposed at the boundary between the blade profile section and the flow path wall surface. The fillet is externally shaped so as to have an arc-shaped curved surface having a radius of R as viewed in a cross-section orthogonal to the flow path wall surface and the blade surface of the blade profile section. A narrow portion existing on the flow path wall surface is configured such that the distance d between the outer edge of a projection of the blade profile section onto the flow path wall surface and the outer edge of the flow path wall surface is smaller than the maximum value of the radius R of the fillet. The upper end of the fillet is positioned lower in the narrow portion than that in a region other than the narrow portion, and the lower end of the arc-shaped curved surface coincides with the flow path wall surface along the entire circumference of the blade profile section.

14 Claims, 6 Drawing Sheets

AXIAL FLOW TURBOMACHINE AND BLADE THEREOF

BACKGROUND OF THE INVENTION

1. Field of the Invention

The present invention relates to an axial flow turbomachine and its blade.

2. Description of the Related Art

A blade disclosed, for example, in JP-2010-156338-A is known as a blade included in an axial flow turbomachine.

SUMMARY OF THE INVENTION

The axial flow turbomachine includes a fillet that is formed, for example, on the base, or a junction to an endwall or the like of a platform, of a blade profile section in order to increase the strength against the centrifugal stress of a rotor blade. However, the distance d between the outer circumferential surface of the blade profile section and an edge of the endwall is short. In some cases, therefore, the radius R of the fillet is not smaller than the distance d.

In general, the radius R of the fillet is standardized along the entire circumference such that the edge portion positioned toward the blade profile section of the fillet, or the boundary between the fillet and the blade profile section, is set at a constant height from the endwall along the entire circumference of the blade profile section. Therefore, in a region where the distance d is smaller than the radius R, the fillet is shaped as if its middle is cut so as to generate a level difference between the fillet and the surface of the endwall. The surface of the endwall forms a flow path wall surface for a working fluid. Therefore, a significant level difference generated by the fillet results in degraded aerodynamic performance. Surface irregularities may be reduced when the radius R of the fillet is set to the minimum value of the distance d. In that case, however, the fillet is excessively small. As a result, the concentration of centrifugal stress might adversely affect the reliability of the blade.

The present invention provides an axial flow turbomachine and its blade that are capable of achieving high aerodynamic performance and high blade reliability in a well-balanced manner.

According to an aspect of the present invention, there is provided a blade for an axial flow turbomachine. The blade includes a blade profile section, an endwall, and a fillet. The endwall has a flow path wall surface that is disposed at least on a hub side of the blade profile section having a tip side and the hub side, and adapted to demarcate a part of an annular flow path of a working fluid. The fillet is disposed at the boundary between the blade profile section and the flow path wall surface along an entire circumference of the blade profile section. The fillet is externally shaped so as to have an arc-shaped curved surface having a radius of R as viewed in a cross-section orthogonal to the flow path wall surface and a blade surface of the blade profile section. A narrow portion existing on the flow path wall surface is configured such that a distance d between an outer edge of a projection of the blade profile section onto the flow path wall surface and an outer edge of the flow path wall surface is smaller than a maximum value of the radius R of the fillet. When a height is taken in a blade length direction from the flow path wall surface, an upper end of the arc-shaped curved surface of the fillet in the narrow portion is disposed lower than an upper end of the arc-shaped curved surface of the fillet in another place, and the lower end of the arc-shaped curved surface coincides with the flow path wall surface along the entire circumference of the blade profile section including the narrow portion.

The present invention makes it possible to achieve high aerodynamic performance and high blade reliability in a well-balanced manner.

DESCRIPTION OF THE PREFERRED EMBODIMENTS

Embodiments of the present invention will now be described with reference to the accompanying drawings.

First Embodiment

—Turbomachine—

Figure 1:
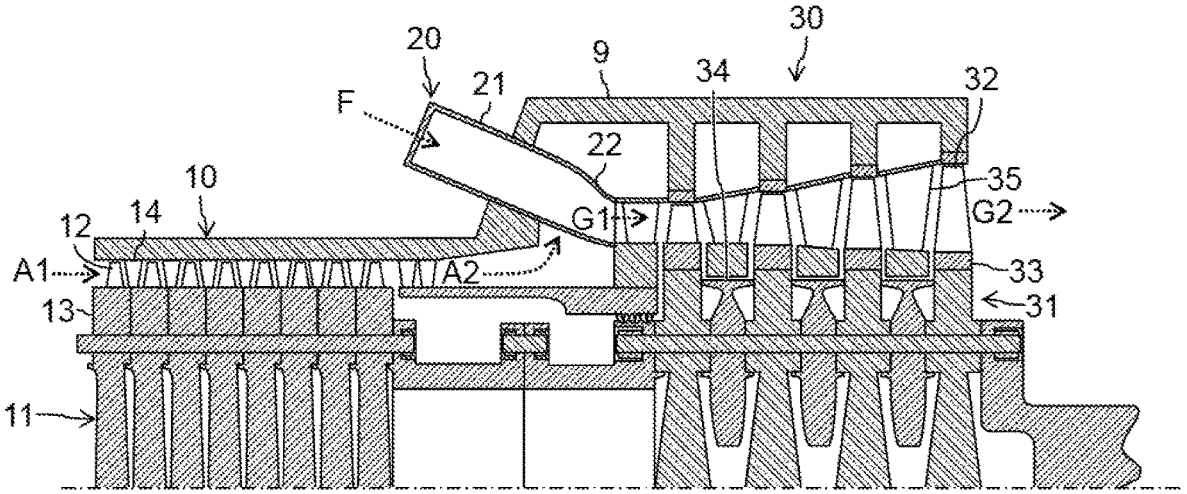
FIG. 1 is a partial cross-sectional view of a gas turbine that is an example of a turbomachine according to an embodiment of the present invention.

FIG. 1 is a partial cross-sectional view of a gas turbine that is an example of a turbomachine according to an embodiment of the present invention. The gas turbine depicted in FIG. 1 includes a compressor 10, a combustor 20, and a turbine 30. The compressor 10 draws in and compresses atmospheric air A1. The combustor 20 receives compressed air A2 from the compressor 10 and burns a fuel F mixed with the received compressed air A2. The turbine 30 is driven by a combustion gas G1 from the combustor 20.

A rotor 11 of the compressor 10 and a rotor 31 of the turbine 30 are coaxially coupled to each other. As load equipment, for example, a generator is coupled to the rotor 11 or the rotor 31. Accordingly, the generator rotates together with the rotor 31 of the turbine 30 so as to convert rotational energy of the rotor 31 to electrical energy. A combustion gas G2 that has given shaft power to the rotor 31 is discharged from the gas turbine, introduced, for example, into a purification apparatus, and then emitted. In some cases, a pump may be coupled as the load equipment so as to use the gas turbine as a prime mover for the pump.

The rotor 11 of the compressor 10 is rotatably accommodated in a casing 9 that is the outer shell of the gas turbine. The rotor 11 is configured such that a plurality of discs 13 having a plurality of rotor blades 12 circumferentially disposed on the outer circumference are alternately stacked in the axial direction. Further, an annular cascade of stator blades 14 is secured within the casing 9 at each down-stepped section in such a manner as to face the downstream ends of the rotor blades 12. That is to say, one down-stepped section is formed by one annular cascade of rotor blades 12 and one annular cascade of stator blades 14 facing the downstream end of the annular cascade of rotor blades 12.

The combustor 20 includes a combustor liner 21 and a tail pipe 22 in addition to elements not depicted, such as an outer casing and a burner. The combustor liner 21 forms a combustion chamber for burning the fuel F mixed with the compressed air A2. The tail pipe 22 connects the combustor liner 21 to the turbine 30. The outer casing surrounds the combustor liner 21 and the tail pipe 22. A cylindrical air flow path is formed between the combustor liner 21, the tail pipe 22, and the outer casing.

The rotor 31 of the turbine 30 is rotatably accommodated in the casing 9. The rotor 31 is configured such that a plurality of spacers 34 and a plurality of discs 33 having a plurality of rotor blades 32 circumferentially disposed on the outer circumference are alternately stacked in the axial direction. Further, an annular cascade of stator blades 35 is secured within the casing 9 at each down-stepped section in such a manner as to face the upstream ends of the rotor blades 12. That is to say, one down-stepped section is formed by one annular cascade of rotor blades 32 and one annular cascade of stator blades 35 facing the upstream end of the annular cascade of rotor blades 32.

In the gas turbine depicted in FIG. 1, the rotor blades 12 and stator blades 14 of the compressor 10 and the rotor blades 32 and stator blades 35 of the turbine 30 may correspond to the blades according to an embodiment of the present invention. Further, although a gas turbine is illustrated in the present example, the present invention is also applicable to the rotor blades and stator blades of a steam turbine. Furthermore, although FIG. 1 illustrates a single-shaft gas turbine, the present invention is also applicable to a two-shaft gas turbine. The rotor blades 12 of the compressor 10 will now be described in detail as a representative example of the structure of the blades according to an embodiment of the present invention.

—Blades—

Figure 2:
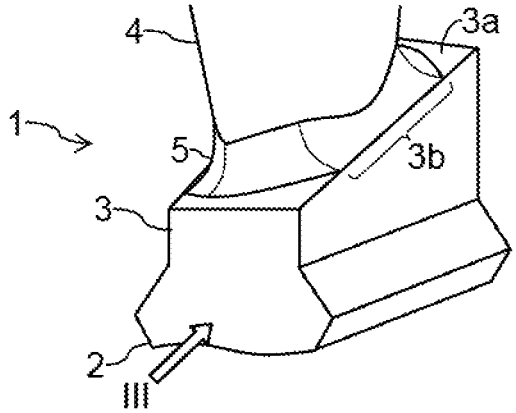
FIG. 2 is a perspective view illustrating essential parts of a blade according to a first embodiment of the present invention.
Figure 3:
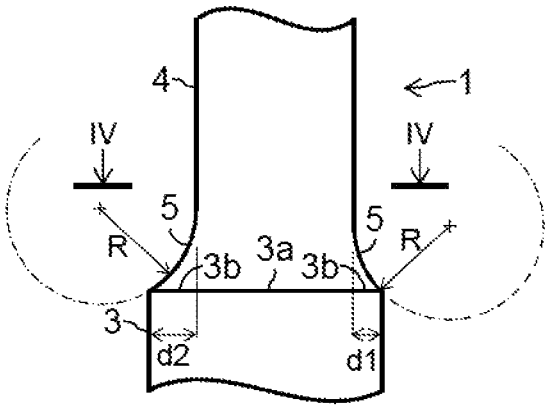
FIG. 3 is a diagram illustrating the blade according to the first embodiment of the present invention as viewed from upstream of a working fluid.
Figure 4:
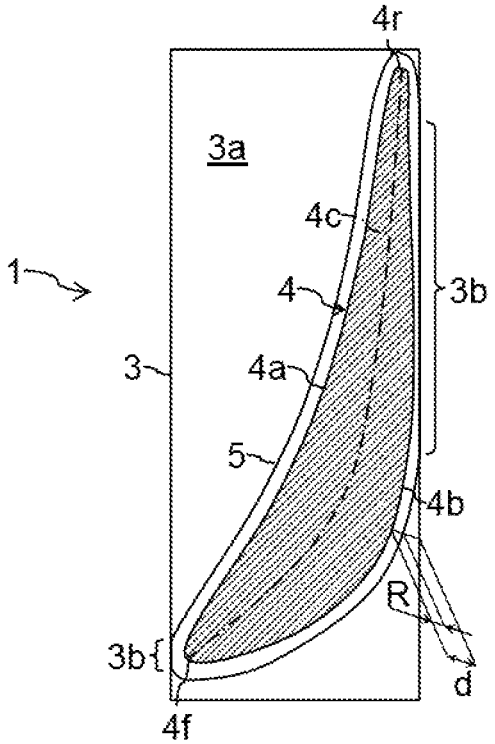
FIG. 4 is a cross-sectional view of the blade taken along line IV-IV in FIG. 3.
Figure 5:
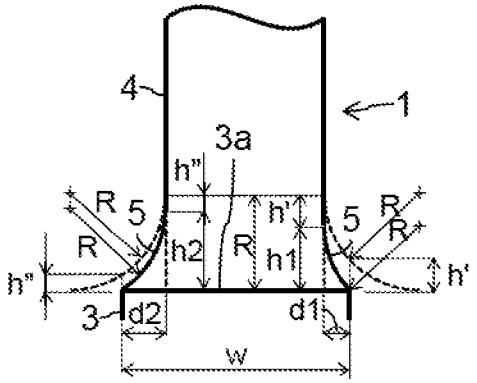
FIG. 5 is a diagram illustrating the shape of the blade according to the first embodiment of the present invention.

FIG. 2 is a perspective view illustrating essential parts of a blade according to a first embodiment of the present invention. FIG. 3 is a diagram illustrating the blade depicted in FIG. 2 as viewed from upstream of a working fluid, or as viewed in the direction of arrow III in FIG. 2. FIG. 4 is a cross-sectional view of the blade taken along line IV-IV in FIG. 3. FIG. 5 is a diagram illustrating the shape of the blade according to the first embodiment. The blade 1 depicted in FIGS. 2 to 5 is a rotor blade 12 of the compressor 10 as mentioned earlier. The rotor blade 12 of the compressor 10 includes a blade root section 2, an endwall 3, a blade profile section 4, and a fillet 5. In the present embodiment, the blade root section 2, the endwall 3, the blade profile section 4, and the fillet 5 are integrally formed, e.g., the blade 1 is formed by integrally shaving a material.

The blade root section 2 is used to attach the blade 1 to the outer circumference of a disc 13, see FIG. 1, of the compressor 10.

The endwall 3 is referred to also as a platform or a dovetail and its surface facing outward in the radial direction of the compressor forms a flow path wall surface 3*a*. The flow path wall surface 3*a* demarcates a part of an annular flow path of the working fluid, that is, a flow path for drawing in and distributing the atmospheric air A1. As regards the compressor 10 in the present embodiment, the flow path wall surface 3*a* is oriented toward the downstream end of the working fluid and tilted outward in the radial direction of the compressor, see FIG. 2.

The blade profile section 4 has an end, or the root end in the example of FIG. 2, that is supported by the flow path wall surface 3*a* of the endwall 3. The blade profile section 4 has a recessed front side surface, or pressure surface, 4*a* and a projected back side surface, or negative pressure surface, 4*b*. When a blade center surface 4*c* is assumed to be a curved surface passing through an intermediate point between the front side surface 4*a* and back side surface 4*b* of an orthogonal cross-section, see FIG. 4 as well, that is cut at an appropriate position in a blade length direction, the thickness of the blade profile section 4 increases in a direction from a front edge 4*f* to a blade center along the blade center surface 4*c* and decreases in a direction from the blade center to a rear edge 4*r*.

In the present embodiment, it is assumed that the endwall 3 is disposed only on a hub side, or the lower side in FIG. 2, of the blade profile section 4 having both the hub side and a tip side, or the upper side in FIG. 2. In some cases, however, the endwall 3 may exist on the tip side of the blade profile section 4 in addition to the hub side. The endwall 3 existing on the tip side of the blade profile section 4 of the rotor blade 12 is referred to also as an integral cover. As regards a blade other than the rotor blade 12, the rotor blade 32 of the turbine 30 is similar to the rotor blade 12 of the compressor 10 in that the endwall 3 is disposed at least on the hub side of the blade profile section 4, which has both the tip side and the hub side. The endwall 3 also exists on the hub side, or the lower side in FIG. 1, and the tip side, or the upper side in FIG. 1, of the blade profile section 4 of the stator blades 14 and 35 of the compressor 10 and turbine 20. The endwall 3 on the hub side is referred to also as a diaphragm inner ring, and the endwall 3 on the tip side is referred to also as a diaphragm outer ring. Both of these endwalls 3 form the flow path wall surface, that is, the inner or outer circumferential wall surface of the annular flow path, of the working fluid, or air and combustion gas.

—Fillet—

The fillet 5 is an element disposed for strength enhancement, and annularly disposed at the boundary between the blade profile section 4 and the flow path wall surface 3*a* of the endwall 3 along the entire circumference of the blade profile section 4. The surface of the fillet 5 is a recessed curved surface that smoothly connects the blade surface of the blade profile section 4 to the flow path wall surface 3*a*. When viewed, for example, in a cross-section orthogonal to the flow path wall surface 3*a* and the blade surface of the blade profile section 4, the fillet 5 is externally formed by an arc that has a radius of R and that circumscribes the end of the flow path wall surface 3*a* and the blade surface of the blade profile section 4. That is to say, the surface of the fillet 5 is a recessed arc-shaped curved surface that has a cross-section having a radius of R. FIG. 3 is drawn from a viewpoint along the flow path wall surface 3*a*. Therefore, when viewed in a cross-section orthogonal to the flow path wall surface 3*a* and the blade surface of the blade profile section 4, the fillet 5 has the same external form as that depicted in FIG. 3. In the present embodiment, the radius R of the fillet 5 in the above-mentioned cross-section is constant within the entire circumferential region of the blade profile section 4.

Here, a distance d is assumed to be the dimension measured between the outer edge of a projection, which corresponds to a hatched drawing in FIG. 4, of the blade profile section 4 onto the flow path wall surface 3*a* and the outer edge of the flow path wall surface 3*a* in a direction orthogonal to the blade surface of the blade profile section 4 along the flow path wall surface 3*a*. The flow path wall surface 3*a* has a region where the distance d is smaller than the maximum value, which is fixed at R in the present example, of the radius R of the fillet 5. In the present document, the region where R>d is referred to as a narrow portion 3*b*. It is assumed that the blade to which the present invention is applicable has the narrow portion existing at least on the back side of the blade profile section, which has both the front side and the back side. In the present embodiment, the narrow portion 3*b* exists on both the back side and the front side.

Further, when the height is taken in the blade length direction from the flow path wall surface 3*a* to the blade profile section 4, the height of the upper end of the arc-shaped curved surface of the fillet 5 in the narrow portion 3*b* is assumed to be h1, see FIG. 5. The height of the upper end of the arc-shaped curved surface of the fillet 5 in a region other than the narrow portion 3*b* is equal to the radius R. The greatest feature of the present embodiment is that the height of the upper end of the arc-shaped curved surface of the fillet 5 in the narrow portion 3*b* is smaller than the height of the upper end of the arc-shaped curved surface of the fillet 5 in a region other than the narrow portion 3*b*, that is, h1<R. Thus, by varying the height of the upper end of the fillet 5 as described above, the lower end, or the end positioned toward the flow path wall surface 3*a*, of the arc-shaped curved surface of the fillet 5 coincides with the flow path wall surface 3*a* within the entire circumferential region of the blade profile section 4 including the narrow portion 3*b*. When viewed from the lateral surface of the endwall 3, or viewed in the direction of rotor rotation, the lower end of the fillet 5 coincides with the flow path wall surface 3*a* and is linearly extended in the flow direction of the working fluid without a level difference, see FIG. 2.

Comparative Example

Figure 10:
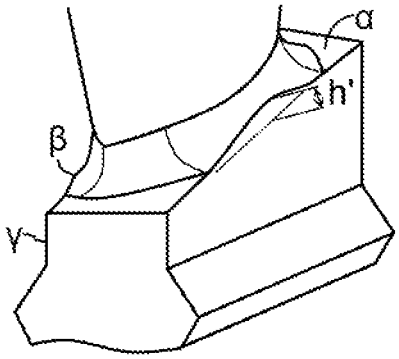
FIG.10 PRIOR ART
FIG. 10 is a perspective view illustrating essential parts of a blade according to a prior art.
Figure 11:
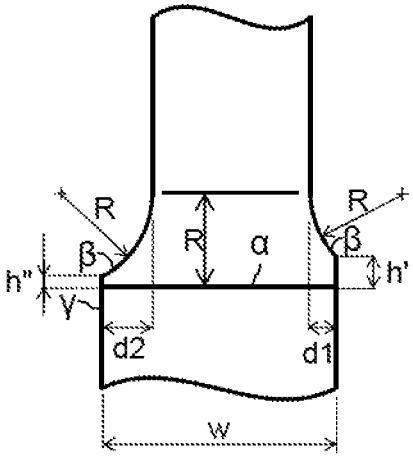
FIG.11 PRIOR ART
FIG. 11 is a view of the blade according to the prior art as viewed from upstream of the working fluid.

FIG. 10 is a perspective view illustrating essential parts of a blade according to a prior art. FIG. 11 is a view of the blade according to the prior art as viewed from upstream of the working fluid. FIG. 10 corresponds to FIG. 2 and FIG. 11 corresponds to FIG. 3. In the comparative example depicted in FIGS. 10 and 11, the height of the upper end of a fillet β that is taken from the flow path wall surface α is constant, that is, "=R" irrespective of the distance d. Referring to FIG. 11, the distances d1 and d2 of the back side and front side of the blade profile section are both smaller than the radius R of the cross-section of the fillet β. Therefore, when the width w of the endwall γ is small, heights h' and h" from the flow path wall surface α occur at the lower end of the arc-shaped curved surface of the fillet β. Thus, level differences having the heights h' and h" are generated by the fillet β with respect to the flow path wall surface α at both widthwise ends of the endwall γ as viewed in the flow direction of the working fluid. The heights h' and h" of the level differences increase with a decrease in the width w of the endwall γ with respect to the blade profile section and with a decrease in the distances d1 and d2. The level differences adversely affect aerodynamic performance.

Meanwhile, the present embodiment is configured as depicted in FIG. 5 such that, in the narrow portion 3*b*, the fillet 5 maintains the same radius R as the fillet, see the broken line, in the comparative example, and is parallel-shifted toward the flow path wall surface 3*a* by amounts equivalent to the heights h' and h" of the level differences of the fillet in the comparative example. Consequently, the resulting configuration is such that both widthwise ends of the endwall 3 have no level difference generated by the fillet 5 with respect to the flow path wall surface 3*a*.

—Advantages—

(1) Balanced Achievement of Aerodynamic Performance and Blade Reliability

The present embodiment is configured such that the fillet 5 generates no level difference on the outer edge of the flow path wall surface 3*a* even in the narrow portion 3*b* on the flow path wall surface 3*a* of the endwall 3 as mentioned above. This reduces aerodynamic performance degradation that may occur when the fillet generates a level difference on the outer edge of the flow path wall surface in the narrow portion. Further, the narrow portion 3*b* inhibits the height of the fillet 5 from decreasing depending on the distance d. This prevents the whole fillet 5 from becoming excessively small and provides high strength reliability. Consequently, high aerodynamic performance and high blade reliability, or strength, can be achieved in a well-balanced manner. In the present embodiment, particularly, the radius R of the fillet 5 remains unchanged even in the narrow portion 3*b*. This reduces changes in the height of the fillet 5 in the narrow portion 3*b* and highly effectively suppresses a decrease in strength.

(2) Ease of Production

As the radius R, or curvature radius, of the arc-shaped curved surface of the fillet 5 remains unchanged, the fillet 5 can be easily formed and produced.

Second Embodiment

Figure 6:
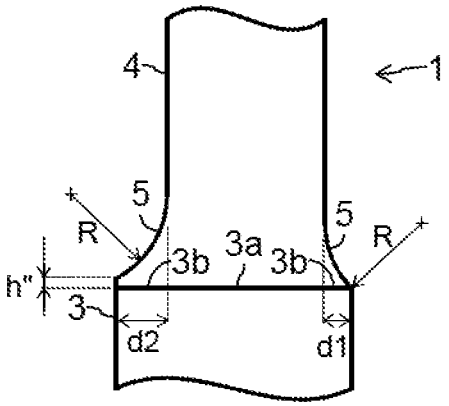
FIG. 6 is a diagram illustrating the blade according to a second embodiment of the present invention as viewed from upstream of the working fluid.

FIG. 6 is a diagram illustrating the blade according to a second embodiment of the present invention as viewed from upstream of the working fluid. FIG. 6 corresponds to FIG. 3, which depicts the first embodiment. Elements depicted in FIG. 6 and identical with or corresponding to those of the blade according to the first embodiment are designated by the same reference numerals as in the preceding figures and will not be redundantly described. The second embodiment differs from the first embodiment in the shape of the fillet. The fillet shape adopted by the second embodiment is such that the lower end of the arc-shaped curved surface of the fillet 5 coincides with the flow path wall surface 3*a* only in the narrow portion 3*b* of the back side, or the right side in FIG. 6, of the blade profile section 4 having both the back side and the front side. The radius R of the fillet 5 in the cross-section orthogonal to the flow path wall surface 3*a* and the blade surface of the blade profile section 4 is constant within the entire circumferential region of the blade profile section 4, as is the case with the first embodiment. In the narrow portion 3*b* on the front side, or the left side in FIG. 6, the lower end of the arc-shaped curved surface of the fillet 5 has a level difference having the height h" with respect to the flow path wall surface 3*a*, as is the case with the comparative example, see FIG. 11. In other respects, the second embodiment is the same as the first embodiment.

The level difference of the flow path wall surface significantly affects aerodynamic performance on the back side of the blade profile section. Therefore, even when a fillet structure generating no level difference is applied to the back side only, the aerodynamic performance is highly improved. Further, machining is performed easy compared with the first embodiment.

The features of the second embodiment are also applicable to third and fourth embodiments described later.

Third Embodiment

Figure 7:
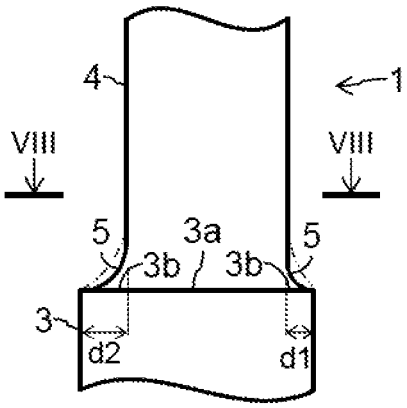
FIG. 7 is a diagram illustrating the blade according to a third embodiment of the present invention as viewed from upstream of the working fluid.
Figure 8:
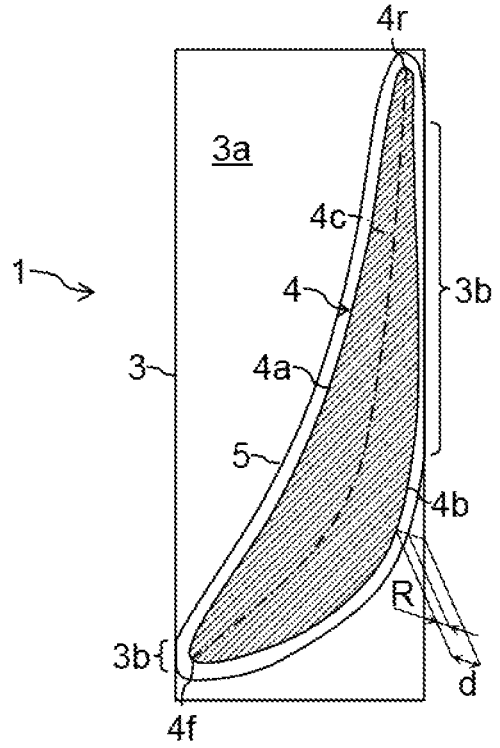
FIG. 8 is a cross-sectional view of the blade taken along line VIII-VIII in FIG. 7.

FIG. 7 is a diagram illustrating the blade according to a third embodiment of the present invention as viewed from upstream of the working fluid. FIG. 8 is a cross-sectional view of the blade taken along line VIII-VIII in FIG. 7. FIG. 7 corresponds to FIG. 3, which depicts the first embodiment. Elements depicted in FIGS. 7 and 8 and identical with or corresponding to those of the blade according to the first embodiment are designated by the same reference numerals as in the preceding figures and will not be redundantly described. The third embodiment differs from the first embodiment in that the radius R of the fillet 5 varies to make the radius R of the arc-shaped curved surface of the fillet 5 small in the narrow portion 3*b* compared with that in a region other than the narrow portion 3*b*. As is the case with the first embodiment, the radius R is the radius of an arc-shaped portion of a cross-section of the fillet 5 that is orthogonal to the flow path wall surface 3*a* and the blade surface of the blade profile section 4.

In the third embodiment, the radius R is equal to the distance d in the narrow portion 3*b*, and is set to a constant value smaller than the distance d in a region other than the narrow portion 3*b*. That is to say, the radius R of the cross-section of the fillet 5 basically remains unchanged, but continuously varies depending on the distance d in the narrow portion 3*b*. As indicated in FIG. 7 by a two-dot chain line representing the outline of the fillet in the first embodiment, the radius R of the fillet 5 in the narrow portion 3*b* is equal to the distance d and smaller than that in the first embodiment. Accordingly, the height of the fillet 5 in the narrow portion 3*b* is smaller by the same amount than that in the first embodiment. Meanwhile, the shape of the fillet 5 as viewed in the blade length direction is the same as in the first embodiment, see FIG. 8. In other respects, the third embodiment is the same as the first embodiment.

Even when the above-described configuration is adopted, the height of the fillet 5 can be sufficiently obtained in a region other than the narrow portion 3*b*, as is the case with the first embodiment. Therefore, the above-described configuration provides greater strength than a configuration where the height of the fillet 5 is uniformly decreased according to the minimum value of the distance d. Further, as is the case with the first embodiment, the fillet 5 generates no level difference on the edge of the flow path wall surface 3*a*. Furthermore, the fillet 5 in the narrow portion 3*b* is lower and smaller than that in the first embodiment. Moreover, the fillet 5 is smoothly connected to the flow path wall surface 3*a*. Consequently, the third embodiment is better than the first embodiment in terms of aerodynamic resistance. However, from the viewpoint of blade strength, the first embodiment is better than the third embodiment by the amount of height difference of the fillet 5 in the narrow portion 3*b*.

Fourth Embodiment

Figure 9:
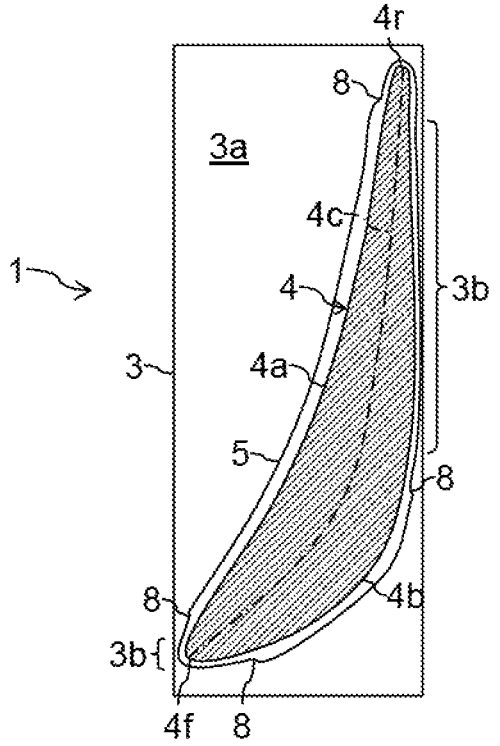
FIG. 9 is a cross-sectional view of the blade according to a fourth embodiment of the present invention.

FIG. 9 is a cross-sectional view of the blade according to a fourth embodiment of the present invention. FIG. 9 corresponds to FIG. 8, which depicts the third embodiment. Elements depicted in FIG. 9 and identical with or corresponding to those of the blade according to the first embodiment are designated by the same reference numerals as in the preceding figures and will not be redundantly described. The fourth embodiment is similar to the third embodiment in that the radius R of the cross-section of the fillet 5 varies. However, the fourth embodiment differs from the third embodiment in that the radius R in the narrow portion 3*b* does not continuously varies but changes in two steps. More specifically, the fillet 5 in a region including the narrow portion 3*b* and sandwiched between two boundaries 8 has a smaller radius R than that of the fillet 5 in a region excluding the narrow portion 3*b* and sandwiched between the two boundaries 8. In the region including the narrow portion 3*b*, the radius R is set to a constant value equal to or slightly smaller than the minimum value of the distance d. In the region excluding the narrow portion 3*b*, the radius R is set to a constant value smaller than the distance d, or set to a value greater than the radius R in the region including the narrow portion, as is the case with the radius R of the fillet 5 in the region other than the narrow portion 3*b* in the first embodiment. Obviously, the fourth embodiment is similar to the first to third embodiments in that the lower end of the arc-shaped curved surface of the fillet 5 coincides with the flow path wall surface 3*a*. In other respects, the fourth embodiment is the same as the first embodiment.

The fourth embodiment provides substantially the same advantages as the third embodiment. Further, as the radius R of the cross-section of the arc-shaped curved surface of the fillet 5 remains unchanged in the region including the narrow portion 3*b*, the fourth embodiment provides easier production than the third embodiment in which the radius R continuously varies in the narrow portion 3*b*.

What is claimed is:

1. A blade for an axial flow turbomachine, the blade comprising:

a blade profile section;

an endwall that has a flow path wall surface disposed at least on a hub side of the blade profile section having a tip side and the hub side, and demarcates a part of an annular flow path of a working fluid; and a fillet that is disposed at the boundary between the blade profile section and the flow path wall surface along an entire circumference of the blade profile section, wherein the fillet is externally shaped so as to have an arc-shaped curved surface having a radius of R as viewed in a cross-section orthogonal to the flow path wall surface and a blade surface of the blade profile section, a narrow portion existing on the flow path wall surface is configured such that a distance d between an outer edge of a projection of the blade profile section onto the flow path wall surface and an outer edge of the flow path wall surface is smaller than a maximum value of the radius R of the fillet, and when a height is taken in a blade length direction from the flow path wall surface, an upper end of the arc-shaped curved surface of the fillet in the narrow portion is disposed lower than a lowest part of an upper end of the arc-shaped curved surface of the fillet in a region other than the narrow portion, and the lower end of the arc-shaped curved surface coincides with the flow path wall surface along the entire circumference of the blade profile section including the narrow portion.

2. The blade for an axial flow turbomachine, according to claim 1, wherein the narrow portion exists at least on a back side of the blade profile section having the back side and a front side.

3. The blade for an axial flow turbomachine, according to claim 1, wherein the radius R of the fillet in the cross-section is constant along the entire circumference of the blade profile section.

4. The blade for an axial flow turbomachine, according to claim 1, wherein the radius R in the cross-section of the arc-shaped curved surface in the narrow portion is small compared with the radius R in the region other than the narrow portion.

5. The blade for an axial flow turbomachine, according to claim 4, wherein the radius R in the narrow portion is equal to the distance d.

6. An axial flow turbomachine comprising:

a stator blade that is the blade according to claim 1; and a rotor blade that forms one down-stepped section together with the stator blade.

7. An axial flow turbomachine comprising:

a rotor blade that is the blade according to claim 1; and a stator blade that forms one down-stepped section together with the rotor blade.

8. A blade for an axial flow turbomachine, the blade comprising:

a blade profile section;

an endwall that has a flow path wall surface disposed at least on a hub side of the blade profile section having a tip side and the hub side, and demarcates a part of an annular flow path of a working fluid; and a fillet that is disposed at the boundary between the blade profile section and the flow path wall surface along an entire circumference of the blade profile section, wherein the fillet is externally shaped so as to have an arc-shaped curved surface having a radius of R as viewed in a cross-section orthogonal to the flow path wall surface and a blade surface of the blade profile section, a narrow portion existing on the flow path wall surface is configured such that a distance d between an outer edge of a projection of the blade profile section onto the flow path wall surface and an outer edge of the flow path wall surface is smaller than a maximum value of the radius R of the fillet, and when a height is taken in a blade length direction from the flow path wall surface, an upper end of the arc-shaped curved surface of the fillet in the narrow portion is disposed lower than whole of an upper end of the arc-shaped curved surface of the fillet in a region other than the narrow portion, and the lower end of the arc-shaped curved surface coincides with the flow path wall surface along the entire circumference of the blade profile section including the narrow portion.

9. The blade for an axial flow turbomachine, according to claim 8, wherein the narrow portion exists at least on a back side of the blade profile section having the back side and a front side.

10. The blade for an axial flow turbomachine, according to claim 8, wherein the radius R of the fillet in the cross-section is constant along the entire circumference of the blade profile section.

11. The blade for an axial flow turbomachine, according to claim 8, wherein the radius R in the cross-section of the arc-shaped curved surface in the narrow portion is small compared with the radius R in the region other than the narrow portion.

12. The blade for an axial flow turbomachine, according to claim 11, wherein the radius R in the narrow portion is equal to the distance d.

13. An axial flow turbomachine comprising:

a stator blade that is the blade according to claim 8; and a rotor blade that forms one down-stepped section together with the stator blade.

14. An axial flow turbomachine comprising:

a rotor blade that is the blade according to claim 8; and a stator blade that forms one down-stepped section together with the rotor blade.

* * * * *